US010650754B2

(12) United States Patent
Nathan et al.

(10) Patent No.: US 10,650,754 B2
(45) **Date of Patent: *May 12, 2020**

(54) STABLE DRIVING SCHEME FOR ACTIVE MATRIX DISPLAYS

(71) Applicant: Ignis Innovation Inc., Waterloo (CA)

(72) Inventors: Arokia Nathan, Cambridge (GB); Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/568,511

(22) Filed: Sep. 12, 2019

(65) Prior Publication Data

US 2020/0005715 A1 Jan. 2, 2020

Related U.S. Application Data

(63) Continuation of application No. 16/159,944, filed on Oct. 15, 2018, now Pat. No. 10,453,397, which is a (Continued)

(30) Foreign Application Priority Data

Apr. 19, 2006 (CA) ..... 2544090

(51) Int. Cl.
*G09G 3/3258* (2016.01)
*G09G 3/3233* (2016.01)
*G09G 3/3208* (2016.01)

(52) U.S. Cl.
CPC ..... *G09G 3/3258* (2013.01); *G09G 3/3208* (2013.01); *G09G 3/3233* (2013.01); (Continued)

(58) Field of Classification Search
CPC ..... G09G 3/3233; G09G 3/3258; G09G 2320/043; G09G 2310/0254; (Continued)

(56) References Cited

U.S. PATENT DOCUMENTS 4,652,872 A * 3/1987 Fujita ..... G09G 3/30 345/208
4,774,420 A * 9/1988 Sutton ..... H03K 17/567 327/109

(Continued)

*Primary Examiner* — Michael Pervan
(74) *Attorney, Agent, or Firm* — Stratford Managers Corporation

(57) ABSTRACT

A method and system for operating a pixel array having at least one pixel circuit is provided. The method includes repeating an operation cycle defining a frame period for a pixel circuit, including at each frame period, programming the pixel circuit, driving the pixel circuit, and relaxing a stress effect on the pixel circuit, prior to a next frame period. The system includes a pixel array including a plurality of pixel circuits and a plurality of lines for operation of the plurality of pixel circuits. Each of the pixel circuits includes a light emitting device, a storage capacitor, and a drive circuit connected to the light emitting device and the storage capacitor. The system includes a drive for operating the plurality of lines to repeat an operation cycle having a frame period so that each of the operation cycle comprises a programming cycle, a driving cycle and a relaxing cycle for relaxing a stress on a pixel circuit, prior to a next frame period.

20 Claims, 10 Drawing Sheets

Related U.S. Application Data continuation of application No. 15/807,339, filed on Nov. 8, 2017, now Pat. No. 10,127,860, which is a continuation of application No. 15/462,529, filed on Mar. 17, 2017, now Pat. No. 9,842,544, which is a continuation of application No. 14/263,628, filed on Apr. 28, 2014, now Pat. No. 9,633,597, which is a continuation of application No. 13/909,177, filed on Jun. 4, 2013, now Pat. No. 8,743,096, which is a continuation of application No. 11/736,751, filed on Apr. 18, 2007, now Pat. No. 8,477,121.

(52) U.S. Cl.
CPC ..... *G09G 2300/0814* (2013.01); *G09G 2300/0819* (2013.01); *G09G 2300/0842* (2013.01); *G09G 2300/0866* (2013.01); *G09G 2310/0254* (2013.01); *G09G 2310/0256* (2013.01); *G09G 2320/0233* (2013.01); *G09G 2320/043* (2013.01)

(58) Field of Classification Search
CPC ... G09G 2310/0256; G09G 2300/0819; G09G 2300/0842; G09G 2300/0866; G09G 2310/0205–021
USPC ..... 315/169.1–169.4; 345/76–84, 87–104, 345/204, 208–210
See application file for complete search history.

(56) References Cited

U.S. PATENT DOCUMENTS 4,781,437 A * 11/1988 Shields ..... G09G 3/3688 327/91
4,816,819 A * 3/1989 Enari ..... G09G 3/3611 345/211
4,822,142 A * 4/1989 Yasui ..... G09G 3/20 345/103
4,853,755 A * 8/1989 Okabe ..... G02F 1/1368 257/72
4,870,396 A * 9/1989 Shields ..... G09G 3/3648 345/90
4,907,040 A * 3/1990 Kobayashi ..... G02F 1/1365 257/485
4,937,647 A * 6/1990 Sutton ..... H03K 17/567 257/133
4,955,697 A * 9/1990 Tsukada ..... G02F 1/136213 345/92
4,965,646 A * 10/1990 Ipri ..... G02F 1/13454 257/387
4,968,119 A * 11/1990 Stewart ..... G02F 1/1368 349/43
4,995,703 A * 2/1991 Noguchi ..... G02F 1/13624 345/103
4,996,523 A * 2/1991 Bell ..... G09G 3/3233 345/690
5,177,577 A * 1/1993 Taniguchi ..... G02F 1/1368 257/59
5,181,132 A * 1/1993 Shindo ..... G02F 1/133512 349/155
5,200,846 A * 4/1993 Hiroki ..... G02F 1/1362 257/E21.413
5,204,660 A * 4/1993 Kamagami ..... G09G 3/367 345/95
5,210,045 A * 5/1993 Possin ..... H01L 27/12 148/DIG. 43
5,235,448 A * 8/1993 Suzuki ..... G02F 1/1368 257/59
5,243,272 A * 9/1993 Hall ..... G09G 3/006 324/73.1
5,243,333 A * 9/1993 Shiba ..... G09G 3/2011 327/63
5,245,452 A * 9/1993 Nakamura ..... C08F 220/54 257/350
5,247,375 A * 9/1993 Mochizuki ..... G02F 1/13454 257/59
5,260,817 A * 11/1993 Kaneko ..... G02F 1/13306 349/173
5,270,229 A * 12/1993 Ishihara ..... H01L 29/4908 205/102
5,286,983 A * 2/1994 Sakamoto ..... H01L 27/12 257/291
5,287,206 A * 2/1994 Kanemori ..... G02F 1/136286 349/143
5,287,208 A * 2/1994 Shimoto ..... G02F 1/133711 349/122
5,300,945 A * 4/1994 Iemoto ..... G09G 3/30 345/92
5,311,169 A * 5/1994 Inada ..... G09G 3/2014 345/77
5,311,342 A * 5/1994 Watanabe ..... G02F 1/1345 257/691
5,317,236 A * 5/1994 Zavracky ..... A61B 3/113 438/27
5,317,436 A * 5/1994 Spitzer ..... A61B 3/113 257/E27.111
5,323,172 A * 6/1994 Koden ..... G09G 3/3651 345/97
5,325,106 A * 6/1994 Bahraman ..... G09G 3/004 257/E29.229
5,337,186 A * 8/1994 Oikawa ..... G02B 3/0012 359/628
5,351,145 A * 9/1994 Miyata ..... G09G 3/3648 345/87
5,374,837 A * 12/1994 Uno ..... G02F 1/1345 257/350
5,376,979 A * 12/1994 Zavracky ..... A61B 3/113 257/E27.111
5,377,030 A * 12/1994 Suzuki ..... G02F 1/1309 324/71.3
5,386,179 A * 1/1995 Sato ..... G09G 3/30 315/169.3
5,396,304 A * 3/1995 Salerno ..... A61B 3/113 353/122
5,398,043 A * 3/1995 Takeda ..... G09G 3/3648 345/92
5,404,151 A * 4/1995 Asada ..... G09G 3/3674 326/113
5,406,304 A * 4/1995 Shirayama ..... G09G 3/3648 345/560
5,416,341 A * 5/1995 Hayama ..... H01L 21/2022 257/59
5,418,636 A * 5/1995 Kawasaki ..... H01L 29/458 349/138
5,424,753 A * 6/1995 Kitagawa ..... G09G 3/3648 345/58
5,432,626 A * 7/1995 Sasuga ..... G02F 1/133308 349/58
5,434,433 A * 7/1995 Takasu ..... G02F 1/13454 257/59
5,438,241 A * 8/1995 Zavracky ..... A61B 3/113 315/169.3
5,444,557 A * 8/1995 Spitzer ..... A61B 3/113 349/42
5,455,598 A * 10/1995 Clerc ..... G09G 3/3648 345/92
5,471,225 A * 11/1995 Parks ..... G02F 1/1368 345/205
5,475,514 A * 12/1995 Salerno ..... A61B 3/113 438/27
5,477,357 A * 12/1995 Suzuki ..... G02F 1/133308 349/110
5,485,293 A * 1/1996 Robinder ..... G02F 1/1368 345/88
5,497,146 A * 3/1996 Hebiguchi ..... G02F 1/136204 257/452
5,508,216 A * 4/1996 Inoue ..... H01L 27/1214 438/151

(56) References Cited

U.S. PATENT DOCUMENTS 5,508,591 A * 4/1996 Kanemori ..... G02F 1/1362 315/169.3
5,510,748 A * 4/1996 Erhart ..... G09G 3/3688 327/530
5,517,542 A * 5/1996 Huq ..... G11C 19/184 377/78
5,519,521 A * 5/1996 Okimoto ..... G02F 1/1368 349/42
5,526,014 A * 6/1996 Shiba ..... G09G 3/3688 345/96
5,528,395 A * 6/1996 So ..... G02F 1/1368 349/42
5,550,066 A * 8/1996 Tang ..... G09G 3/3225 438/29
5,550,484 A * 8/1996 Mitsumori ..... G01R 31/2608 324/762.09
5,552,909 A * 9/1996 Onisawa ..... G02F 1/1368 349/139
5,554,434 A * 9/1996 Park ..... B82Y 15/00 428/209
5,559,526 A * 9/1996 Izawa ..... G09G 3/3688 345/100
5,563,427 A * 10/1996 Yudasaka ..... G02F 1/13454 257/72
5,576,858 A * 11/1996 Ukai ..... G02F 1/136213 349/139
5,578,957 A * 11/1996 Erhart ..... G09G 3/3688 327/333
5,581,273 A * 12/1996 Yoneda ..... G09G 3/3648 345/90
5,581,385 A * 12/1996 Spitzer ..... A61B 3/113 257/E27.111
5,583,528 A * 12/1996 Ebihara ..... G09G 3/20 345/212
5,583,535 A * 12/1996 Takarada ..... G06F 3/0412 345/104
5,585,647 A * 12/1996 Nakajima ..... H01L 27/1251 257/72
5,585,815 A * 12/1996 Nakashima ..... G02F 1/1345 345/100
5,587,683 A * 12/1996 Kawasaki ..... G09G 3/36 327/538
5,589,847 A * 12/1996 Lewis ..... H01L 27/1214 345/98
5,600,345 A * 2/1997 Dingwall ..... G09G 3/2011 345/100
5,602,561 A * 2/1997 Kawaguchi ..... H04N 3/127 345/99
5,619,225 A * 4/1997 Hashimoto ..... G09G 3/2011 345/88
5,627,560 A * 5/1997 Verhulst ..... G09G 3/3651 345/97
5,633,176 A * 5/1997 Takasu ..... G02F 1/13454 257/E27.112
5,633,653 A * 5/1997 Atherton ..... G09G 3/2011 345/98
5,637,187 A * 6/1997 Takasu ..... G02F 1/13378 438/30
5,640,067 A * 6/1997 Yamauchi ..... G09G 3/3233 313/504
5,642,134 A * 6/1997 Ikeda ..... G06F 3/044 178/18.06
5,648,792 A * 7/1997 Sato ..... G09G 3/3648 345/100
5,648,793 A * 7/1997 Chen ..... G09G 3/3614 345/209
5,650,801 A * 7/1997 Higashi ..... G09G 3/3681 345/210
5,654,811 A * 8/1997 Spitzer ..... G02B 27/0093 349/106
5,661,371 A * 8/1997 Salerno ..... G02B 27/0093 315/169.3
5,664,158 A * 9/1997 Larimer ..... G06F 17/5009 345/10
5,666,133 A * 9/1997 Matsuo ..... G09G 3/3648 345/100
5,666,180 A * 9/1997 Ishizaki ..... G02F 1/136213 351/54
5,668,379 A * 9/1997 Ono ..... H01L 27/1259 257/59
5,670,979 A * 9/1997 Huq ..... G09G 3/2011 345/100
5,671,044 A * 9/1997 Shimada ..... G01N 21/21 356/237.1
5,673,063 A * 9/1997 Weisbrod ..... G09G 3/2011 345/100
5,674,757 A * 10/1997 Kim ..... H01L 27/1214 438/159
5,680,183 A * 10/1997 Sasuga ..... G02F 1/133308 349/150
5,684,362 A * 11/1997 Togawa ..... G02F 1/13334 313/582
5,684,365 A * 11/1997 Tang ..... H01L 27/3244 257/448
5,686,935 A * 11/1997 Weisbrod ..... G09G 3/2011 345/100
5,691,782 A * 11/1997 Nishikawa ..... G02F 1/1368 349/110
5,694,145 A * 12/1997 Kondo ..... G09G 3/3648 345/100
5,701,136 A * 12/1997 Huq ..... G11C 19/28 345/100
5,706,022 A * 1/1998 Hato ..... G02F 1/1368 345/206
5,706,024 A * 1/1998 Park ..... G09G 3/2011 345/96
5,708,485 A * 1/1998 Sato ..... G02F 1/136209 349/42
5,710,606 A * 1/1998 Nakajima ..... H01L 29/78621 349/42
5,714,968 A * 2/1998 Ikeda ..... G09G 3/3233 345/76
5,717,418 A * 2/1998 Shapiro ..... G09G 3/3651 345/89
5,724,111 A * 3/1998 Mizobata ..... G02F 1/133504 349/112
5,726,540 A * 3/1998 Klink ..... H04N 9/648 315/383
5,734,450 A * 3/1998 Irie ..... G02F 1/1309 324/760.01
5,742,267 A * 4/1998 Wilkinson ..... G09G 3/2011 345/75.2
5,745,090 A * 4/1998 Kim ..... G09G 3/3648 345/90
5,748,165 A * 5/1998 Kubota ..... G09G 3/2011 345/96
5,748,268 A * 5/1998 Kalmanash ..... G02F 1/13454 257/350
5,751,279 A * 5/1998 Okumura ..... G09G 3/3648 345/204
5,754,266 A * 5/1998 Ohta ..... G02F 1/133512 349/139
5,757,048 A * 5/1998 Inoue ..... H01L 27/1214 257/344
5,760,757 A * 6/1998 Tanaka ..... G09G 3/3622 345/93
5,760,854 A * 6/1998 Ono ..... H01L 27/1259 349/38
5,763,904 A * 6/1998 Nakajima ..... H01L 21/28512 257/66
5,773,309 A * 6/1998 Weiner ..... H01L 21/2026 438/166
5,774,099 A * 6/1998 Iwasaki ..... G09G 3/3655 345/87
5,774,100 A * 6/1998 Aoki ..... G09G 3/006 345/87
5,781,171 A * 7/1998 Kihara ..... G09G 3/3688 345/93

(56) References Cited

U.S. PATENT DOCUMENTS 5,783,338 A * 7/1998 Cho ..... G02F 1/133512 430/7
5,784,039 A * 7/1998 Yasui ..... G09G 3/3648 345/89
5,784,132 A * 7/1998 Hashimoto ..... G02F 1/136209 349/44
5,790,090 A * 8/1998 Libsch ..... G09G 3/3648 345/94
5,793,342 A * 8/1998 Rhoads ..... G09G 3/30 345/211
5,793,348 A * 8/1998 Lee ..... G09G 3/2011 345/98
5,796,380 A * 8/1998 Kurematsu ..... G09G 3/3651 345/209
5,796,455 A * 8/1998 Mizobata ..... G02F 1/133504 349/112
5,798,535 A * 8/1998 Huang ..... H01L 27/156 257/83
5,798,745 A * 8/1998 Steffensmeier ..... G09G 3/3648 345/208
5,798,806 A * 8/1998 Tsutsui ..... G02F 1/133512 349/29
5,805,128 A * 9/1998 Kim ..... G09G 3/3655 345/96
5,805,246 A * 9/1998 Lee ..... G02F 1/136204 349/40
5,812,104 A * 9/1998 Kapoor ..... G09G 3/2011 345/76
5,825,343 A * 10/1998 Moon ..... G09G 3/3677 345/94
5,828,354 A * 10/1998 Ebihara ..... G09G 3/20 345/58
5,828,367 A * 10/1998 Kuga ..... G06F 1/3218 345/211
5,841,412 A * 11/1998 Ebihara ..... G09G 3/20 345/58
5,847,515 A * 12/1998 Lee ..... G09G 3/2011 315/169.1
5,852,305 A * 12/1998 Lee ..... H01L 27/12 257/59
5,854,616 A * 12/1998 Ota ..... G09G 3/3648 345/100
5,858,820 A * 1/1999 Jung ..... G02F 1/13454 438/150
5,875,009 A * 2/1999 Shibahara ..... G02F 1/1368 349/43
5,883,608 A * 3/1999 Hashimoto ..... G09G 3/3614 345/209
5,886,365 A * 3/1999 Kouchi ..... G02F 1/13454 257/59
5,886,679 A * 3/1999 Matsuda ..... G09G 3/3614 345/96
5,888,855 A * 3/1999 Nagahisa ..... G02F 1/1368 438/158
5,889,502 A * 3/1999 Iwama ..... G09G 3/3662 345/60
5,894,297 A * 4/1999 Mizutome ..... G09G 3/3629 345/211
5,896,117 A * 4/1999 Moon ..... G09G 3/3677 345/95
5,897,182 A * 4/1999 Miyawaki ..... G02F 1/136286 345/93
5,897,188 A * 4/1999 Sasuga ..... G02F 1/133308 349/149
5,897,328 A * 4/1999 Yamauchi ..... G09G 3/3233 148/DIG. 150
5,898,428 A * 4/1999 Zimlich ..... G09G 3/2011 345/204
5,903,246 A * 5/1999 Dingwall ..... G09G 3/3233 345/46
5,907,314 A * 5/1999 Negishi ..... G09G 3/3614 345/100
5,909,035 A * 6/1999 Kim ..... G02F 1/136204 257/59
5,909,262 A * 6/1999 Tomooka ..... G09G 3/3655 349/38
5,920,300 A * 7/1999 Yamazaki ..... G09G 3/3648 345/94
5,926,158 A * 7/1999 Yoneda ..... G09G 3/3648 345/90
5,929,656 A * 7/1999 Pagones ..... G09G 3/20 326/68
5,929,958 A * 7/1999 Ohta ..... G02F 1/133512 349/141
5,933,202 A * 8/1999 Watanabe ..... G09G 3/3655 349/33
5,936,597 A * 8/1999 Hyun ..... G09G 3/22 345/74.1
5,939,833 A * 8/1999 Song ..... G09G 3/22 315/169.1
5,940,053 A * 8/1999 Ikeda ..... G09G 3/3233 345/76
5,940,055 A * 8/1999 Lee ..... G09G 3/3677 345/87
5,940,057 A * 8/1999 Lien ..... G09G 3/3648 345/58
5,945,970 A * 8/1999 Moon ..... G09G 3/3648 345/211
5,946,068 A * 8/1999 Lee ..... G09G 3/3611 349/143
5,949,398 A * 9/1999 Kim ..... G11C 19/28 345/100
5,952,854 A * 9/1999 Kubota ..... G09G 3/3688 327/91
5,953,582 A * 9/1999 Yudasaka ..... G02F 1/13454 438/29
5,956,011 A * 9/1999 Koyama ..... G09G 3/3648 345/98
5,956,111 A * 9/1999 Ohta ..... G02F 1/133512 349/141
5,959,598 A * 9/1999 McKnight ..... G06T 3/40 345/87
5,959,599 A * 9/1999 Hirakata ..... G09G 3/3659 345/92
5,969,745 A * 10/1999 Ziemer ..... H04N 1/40025 347/237
5,970,318 A * 10/1999 Choi ..... H01L 27/3274 438/99
5,973,661 A * 10/1999 Kobayashi ..... G09G 3/3648 345/100
5,977,698 A * 11/1999 Lee ..... H01J 3/022 257/12
5,977,961 A * 11/1999 Rindal ..... G09G 3/2085 345/204
5,978,052 A * 11/1999 Ilcisin ..... G09G 3/3662 345/100
5,978,059 A * 11/1999 Ohta ..... G02F 1/133512 349/141
5,982,348 A * 11/1999 Nakajima ..... G02F 1/13454 345/92
5,982,461 A * 11/1999 Hayashi ..... G02F 1/13454 349/43
5,986,724 A * 11/1999 Akiyama ..... G02F 1/1358 345/9
5,990,877 A * 11/1999 Yeo ..... G09G 3/3688 345/204
6,011,529 A * 1/2000 Ikeda ..... G09G 3/3233 345/76
6,011,607 A * 1/2000 Yamazaki ..... G02F 1/13454 349/151
6,018,379 A * 1/2000 Mizobata ..... G02F 1/133504 349/112
6,020,694 A * 2/2000 Shim ..... H04N 3/223 315/387
6,023,259 A * 2/2000 Howard ..... G09G 3/3233 315/169.1
6,025,835 A * 2/2000 Aoki ..... G09G 3/3688 345/204

(56) References Cited

U.S. PATENT DOCUMENTS 6,028,578 A * 2/2000 Ota ..... G09G 3/3648 345/94
6,031,247 A * 2/2000 Lee ..... H01L 27/12 257/54
6,031,514 A * 2/2000 Hashimoto ..... G09G 3/3648 345/100
6,034,807 A * 3/2000 Little ..... G02B 26/02 345/108
6,037,718 A * 3/2000 Nagami ..... H01L 27/3262 315/169.3
6,037,719 A * 3/2000 Yap ..... G09G 3/22 315/169.1
6,037,924 A * 3/2000 Koyama ..... G09G 3/3648 345/92
6,040,613 A * 3/2000 McTeer ..... H01J 1/52 257/437
6,040,886 A * 3/2000 Ota ..... G02F 1/133512 349/141
6,043,812 A * 3/2000 Utsunomiya ..... G09G 3/3688 345/100
6,046,736 A * 4/2000 Atherton ..... G09G 3/2011 345/100
6,057,182 A * 5/2000 Goodman ..... H01L 21/3003 438/162
6,057,818 A * 5/2000 Cole ..... G09G 3/3611 345/100
6,060,827 A * 5/2000 Kichimi ..... H01J 17/485 313/582
6,060,941 A * 5/2000 Brownlow ..... G09G 3/3688 327/425
6,064,222 A * 5/2000 Morita ..... G09G 3/006 324/750.3
6,064,460 A * 5/2000 Ohta ..... G02F 1/133512 349/141
6,067,062 A * 5/2000 Takasu ..... G02F 1/13378 345/87
6,069,600 A * 5/2000 Saishu ..... G02F 1/13624 345/205
6,072,450 A * 6/2000 Yamada ..... G09G 3/3233 345/76
6,072,454 A * 6/2000 Nakai ..... G02F 1/1368 345/97
6,072,456 A * 6/2000 Karube ..... G09G 3/3688 345/98
6,075,524 A * 6/2000 Ruta ..... G09G 3/3688 345/210
6,078,060 A * 6/2000 Shibuya ..... G02F 1/13454 257/66
6,080,643 A * 6/2000 Noguchi ..... H01L 21/2026 438/487
6,081,305 A * 6/2000 Sato ..... G02F 1/13454 349/111
6,081,307 A * 6/2000 Ha ..... G02F 1/136204 349/40
6,084,579 A * 7/2000 Hirano ..... G09G 3/3216 315/169.3
6,091,203 A * 7/2000 Kawashima ..... G09G 3/3241 315/169.3
6,097,359 A * 8/2000 Kwon ..... G09G 3/22 345/74.1
6,107,999 A * 8/2000 Zimlich ..... G09G 3/2011 345/204
6,108,056 A * 8/2000 Nakajima ..... G02F 1/13454 349/38
6,124,840 A * 9/2000 Kwon ..... G09G 3/3677 345/100
6,127,997 A * 10/2000 Tsuchi ..... G09G 3/3688 345/98
6,133,074 A * 10/2000 Ishida ..... H01L 21/268 438/153
6,133,897 A * 10/2000 Kouchi ..... G09G 3/3648 345/100
6,140,667 A * 10/2000 Yamazaki ..... H01L 21/2022 257/59
6,140,990 A * 10/2000 Schlig ..... G09G 3/3659 345/92
6,154,192 A * 11/2000 Katakura ..... G09G 3/3688 345/98
6,157,375 A * 12/2000 Rindal ..... G09G 3/20 345/204
6,157,421 A * 12/2000 Ishii ..... G02F 1/13454 257/67
6,160,271 A * 12/2000 Yamazaki ..... H01L 21/2022 257/59
6,160,272 A * 12/2000 Arai ..... H01L 27/156 257/291
6,160,535 A * 12/2000 Park ..... G09G 3/3607 345/100
6,163,357 A * 12/2000 Nakamura ..... G02F 1/13394 349/155
6,165,810 A * 12/2000 Morimoto ..... H01L 21/67115 438/30
6,172,661 B1 * 1/2001 Imajo ..... G09G 3/2011 345/89
6,172,663 B1 * 1/2001 Okada ..... G09G 3/3614 345/96
6,175,394 B1 * 1/2001 Wu ..... G02F 1/136204 257/360
6,177,301 B1 * 1/2001 Jung ..... H01L 21/2026 438/150
6,187,605 B1 * 2/2001 Takasu ..... G02F 1/13454 438/29
6,191,435 B1 * 2/2001 Inoue ..... G02F 1/136277 257/59
6,191,779 B1 * 2/2001 Taguchi ..... G09G 3/2011 345/204
6,194,308 B1 * 2/2001 McTeer ..... H01J 1/52 438/627
6,195,137 B1 * 2/2001 Inaba ..... G02F 1/141 345/96
6,195,148 B1 * 2/2001 Sasuga ..... G02F 1/133308 349/149
6,195,301 B1 * 2/2001 Huffman ..... G11C 7/12 365/189.03
6,198,133 B1 * 3/2001 Yamazaki ..... H01L 29/42384 257/347
6,198,464 B1 * 3/2001 Ota ..... G09G 3/3648 345/77
6,201,520 B1 * 3/2001 Iketsu ..... G09G 3/3216 345/76
6,201,590 B1 * 3/2001 Ohta ..... G02F 1/133512 349/141
6,207,971 B1 * 3/2001 Jinno ..... G02F 1/13454 257/72
6,208,399 B1 * 3/2001 Ohta ..... G02F 1/134363 349/139
6,211,851 B1 * 4/2001 Lien ..... G09G 3/3648 345/58
6,215,154 B1 * 4/2001 Ishida ..... H01L 21/268 257/347
6,225,991 B1 * 5/2001 McKnight ..... G06T 3/40 345/205
6,229,506 B1 * 5/2001 Dawson ..... G09G 3/3233 345/82
6,229,508 B1 * 5/2001 Kane ..... G09G 3/3233 345/205
6,229,513 B1 * 5/2001 Nakano ..... G09G 3/3688 345/99
6,229,531 B1 * 5/2001 Nakajima ..... G09G 3/3648 345/205
6,232,142 B1 * 5/2001 Yasukawa ..... H01L 21/76254 257/82
6,232,948 B1 * 5/2001 Tsuchi ..... G09G 3/3688 345/99
6,239,779 B1 * 5/2001 Furuya ..... G09G 3/3648 345/87
6,243,064 B1 * 6/2001 Hirakata ..... G09G 3/3659 345/209

(56) References Cited

U.S. PATENT DOCUMENTS 6,246,180 B1 * 6/2001 Nishigaki ..... G09G 3/3233 315/169.3
6,246,384 B1 * 6/2001 Sano ..... G09G 3/3233 345/76
6,249,325 B1 * 6/2001 Ohkawara ..... G02F 1/136213 349/38
6,249,330 B1 * 6/2001 Yamaji ..... G02F 1/136227 349/122
6,259,424 B1 * 7/2001 Kurogane ..... G02F 1/13624 345/87
6,262,703 B1 * 7/2001 Perner ..... G09G 3/3648 345/90
6,266,038 B1 * 7/2001 Yoshida ..... G09G 3/3659 345/100
6,271,816 B1 * 8/2001 Jeong ..... G09G 3/3655 345/87
6,271,825 B1 * 8/2001 Greene ..... G09G 3/2092 345/207
6,278,242 B1 * 8/2001 Cok ..... G09G 3/3233 315/169.1
6,281,057 B2 * 8/2001 Aya ..... H01L 21/2026 438/166
6,281,470 B1 * 8/2001 Adachi ..... H01L 21/2026 219/121.62
6,281,634 B1 * 8/2001 Yokoyama ..... H01L 27/3211 313/506
6,292,183 B1 * 9/2001 Yamazaki ..... H01L 27/12 345/211
6,295,054 B1 * 9/2001 McKnight ..... G06T 3/40 345/205
6,380,689 B1 * 4/2002 Okuda ..... G09G 3/3233 315/169.1
6,417,825 B1 * 7/2002 Stewart ..... G09G 3/30 345/76
6,525,704 B1 * 2/2003 Kondo ..... G09G 3/3233 315/169.3
6,583,775 B1 * 6/2003 Sekiya ..... G09G 3/2081 345/76
6,594,606 B2 * 7/2003 Everitt ..... G09G 3/3216 345/205
6,618,030 B2 * 9/2003 Kane ..... G09G 3/3233 345/82
6,639,244 B1 * 10/2003 Yamazaki ..... G02F 1/13454 257/72
6,677,713 B1 * 1/2004 Sung ..... G09G 3/3233 315/169.1
6,687,266 B1 * 2/2004 Ma ..... C09K 11/06 257/141
6,738,034 B2 * 5/2004 Kaneko ..... G09G 3/3233 345/76
6,812,650 B2 * 11/2004 Yasuda ..... G09G 3/3233 315/169.1
6,859,193 B1 * 2/2005 Yumoto ..... G09G 3/3216 315/169.3
7,015,884 B2 * 3/2006 Kwon ..... G09G 3/3233 257/E27.111
7,023,408 B2 * 4/2006 Chen ..... G09G 3/3233 345/76
7,116,058 B2 * 10/2006 Lo ..... G09G 3/3233 315/169.1
7,167,147 B2 * 1/2007 Tanaka ..... G09G 3/3258 345/76
7,183,719 B2 * 2/2007 Yang ..... G09G 3/3216 315/169.4
7,315,295 B2 * 1/2008 Kimura ..... G09G 3/3258 345/76
7,355,574 B1 * 4/2008 Leon ..... G09G 3/3233 345/101
8,477,121 B2 * 7/2013 Nathan ..... G09G 3/3233 345/204
8,743,096 B2 * 6/2014 Nathan ..... G09G 3/3233 345/204
2001/0004252 A1 * 6/2001 Park ..... G09G 3/3648 345/92
2001/0007447 A1 * 7/2001 Tanaka ..... G09G 3/3258 345/87
2001/0009283 A1 * 7/2001 Arao ..... G02F 1/13454 257/303
2001/0022565 A1 * 9/2001 Kimura ..... G09G 3/3266 345/82
2001/0026257 A1 * 10/2001 Kimura ..... G09G 3/3225 345/87
2002/0030190 A1 * 3/2002 Ohtani ..... G02B 27/017 257/72
2002/0052086 A1 * 5/2002 Maeda ..... H01L 21/82385 438/283
2002/0089474 A1 * 7/2002 Wu ..... G09G 3/3233 345/76
2002/0117722 A1 * 8/2002 Osada ..... G11C 11/412 257/379
2002/0118150 A1 * 8/2002 Kwon ..... G09G 3/3233 345/76
2002/0196212 A1 * 12/2002 Nishitoba ..... G09G 3/3241 345/76
2003/0062524 A1 * 4/2003 Kimura ..... G09G 3/2022 257/72
2003/0076048 A1 * 4/2003 Rutherford ..... G09G 3/3241 315/169.3
2003/0160745 A1 * 8/2003 Osame ..... G09G 3/3258 345/82
2003/0189535 A1 * 10/2003 Matsumoto ..... G09G 3/3233 345/76
2004/0036664 A1 * 2/2004 Miyazawa ..... G09G 3/3233 345/76
2004/0070557 A1 * 4/2004 Asano ..... G09G 3/3233 345/76
2004/0183749 A1 * 9/2004 Vertegaal ..... G06F 3/011 345/7
2005/0067970 A1 * 3/2005 Libsch ..... G09G 3/3233 315/169.3
2005/0105031 A1 * 5/2005 Shih ..... G09G 3/3233 349/139
2005/0157581 A1 * 7/2005 Shiurasaki ..... G09G 3/325 365/230.06
2005/0168491 A1 * 8/2005 Takahara ..... G09G 3/006 345/690
2005/0206590 A1 * 9/2005 Sasaki ..... G09G 3/3233 345/76
2005/0269959 A1 * 12/2005 Uchino ..... G09G 3/3266 315/169.3
2005/0280613 A1 * 12/2005 Takei ..... G09G 3/325 345/76
2006/0007072 A1 * 1/2006 Choi ..... G09G 3/3233 345/76
2006/0152531 A1 * 7/2006 Lin ..... G09G 3/3225 345/613
2006/0176250 A1 * 8/2006 Nathan ..... G09G 3/3233 345/76
2006/0273997 A1 * 12/2006 Nathan ..... G09G 3/3241 345/78
2006/0284801 A1 * 12/2006 Yoon ..... G09G 3/3233 345/76
2007/0001937 A1 * 1/2007 Park ..... G09G 3/3233 345/76
2007/0008268 A1 * 1/2007 Park ..... G09G 3/3233 345/92
2007/0080906 A1 * 4/2007 Tanabe ..... G09G 3/2022 345/76
2007/0103419 A1 * 5/2007 Uchino ..... G09G 3/2011 345/92
2007/0285359 A1 * 12/2007 Ono ..... G09G 3/3233 345/76
2007/0296672 A1 * 12/2007 Kim ..... G09G 3/3233 345/92
2008/0042948 A1 * 2/2008 Yamashita ..... G09G 3/3233 345/82
2008/0074413 A1 * 3/2008 Ogura ..... G09G 3/3233 345/212

(56) References Cited

U.S. PATENT DOCUMENTS

| | | | | |
|---|---|---|---|---|
| 2008/0088549 | A1* | 4/2008 | Nathan | G09G 3/3233 345/80 |
| 2011/0012883 | A1* | 1/2011 | Nathan | G09G 3/3233 345/211 |
| 2012/0007842 | A1* | 1/2012 | Nathan | G09G 3/3233 345/204 |
| 2013/0162507 | A1* | 6/2013 | Nathan | G09G 3/3233 345/84 |
| 2015/0379932 | A1* | 12/2015 | Nathan | G09G 3/3233 345/76 |

* cited by examiner

STABLE DRIVING SCHEME FOR ACTIVE MATRIX DISPLAYS

CROSS REFERENCE TO RELATED APPLICATIONS

This application is a continuation of U.S. patent application Ser. No. 16/159,944, filed Oct. 15, 2018, now allowed, which is a continuation of U.S. patent application Ser. No. 15/807,339, filed Nov. 8, 2017, now U.S. Pat. No. 10,127,860, which is a continuation of U.S. patent application Ser. No. 15/462,529, filed Mar. 17, 2017, now U.S. Pat. No. 9,842,544, which is a continuation of U.S. patent application Ser. No. 14/263,628, filed Apr. 28, 2014, now U.S. Pat. No. 9,633,597, which is a continuation of U.S. patent application Ser. No. 13/909,177, filed Jun. 4, 2013, now U.S. Pat. No. 8,743,096, which is a continuation of U.S. patent application Ser. No. 11/736,751, filed Apr. 18, 2007, now U.S. Pat. No. 8,477,121, issued Jul. 2, 2013, which claims priority to Canadian Patent Application No. 2,544,090, filed Apr. 19, 2006; the entire contents of each of the foregoing are incorporated herein by reference in their respective entireties.

FIELD OF INVENTION

The present invention relates to light emitting device displays, and more specifically to a method and system for driving a pixel circuit.

BACKGROUND OF THE INVENTION

Electro-luminance displays have been developed for a wide variety of devices, such as cell phones. In particular, active-matrix organic light emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having an organic light emitting diode (OLED) and backplane electronics arranged in the array of rows and columns. Since the OLED is a current driven device, the pixel circuit of the AMOLED should be capable of providing an accurate and constant drive current.

However, the AMOLED displays exhibit non-uniformities in luminance on a pixel-to-pixel basis, as a result of pixel degradation, i.e., aging caused by operational use over time (e.g., threshold shift, OLED aging). Depending on the usage of the display, different pixels may have different amounts of the degradation. There may be an ever-increasing error between the required brightness of some pixels as specified by luminance data and the actual brightness of the pixels. The result is that the desired image will not show properly on the display.

Therefore, there is a need to provide a method and system that is capable of suppressing the aging of the pixel circuit.

SUMMARY OF THE INVENTION

It is an object of the invention to provide a method and system that obviates or mitigates at least one of the disadvantages of existing systems.

In accordance with an aspect of the present invention there is provided a method of operating a pixel array having at least one pixel circuit. The method includes the steps of: repeating an operation cycle defining a frame period for a pixel circuit, including at each frame period, programming the pixel circuit, driving the pixel circuit; and relaxing a stress effect on the pixel circuit, prior to a next frame period.

In accordance with another aspect of the present invention there is provided a display system. The display system includes a pixel array including a plurality of pixel circuits and a plurality of lines for operation of the plurality of pixel circuits. Each of the pixel circuits includes a light emitting device, a storage capacitor, and a drive circuit connected to the light emitting device and the storage capacitor. The display system includes a drive for operating the plurality of lines to repeat an operation cycle having a frame period so that each of the operation cycle comprises a programming cycle, a driving cycle and a relaxing cycle for relaxing a stress on a pixel circuit, prior to a next frame period.

This summary of the invention does not necessarily describe all features of the invention.

BRIEF DESCRIPTION OF THE DRAWINGS

These and other features of the invention will become more apparent from the following description in which reference is made to the appended drawings wherein:

FIG. 10(*b*) is a diagram illustrating an example of array structure having bottom emission pixels applicable to the display system of FIG. 4.

DETAILED DESCRIPTION OF THE PREFERRED EMBODIMENTS

Embodiments of the present invention are described using a pixel circuit having an organic light emitting diode (OLED) and a plurality of thin film transistors (TFTs). The pixel circuit may contain a light emitting device other than the OLED. The transistors in the pixel circuit may be n-type transistors, p-type transistors or combinations thereof. The transistors in the pixel circuit may be fabricated using amorphous silicon, nano/micro crystalline silicon, poly silicon, organic semiconductors technologies (e.g., organic TFT), NMOS/PMOS technology, CMOS technology (e.g., MOSFET) or combinations thereof. A display having the pixel circuit may be a single color, multi-color or a fully color display, and may include one or more than one electroluminescence (EL) element (e.g., organic EL). The display may be an active matrix light emitting display (e.g., AMOLED). The display may be used in DVDs, personal digital assistants (PDAs), computer displays, or cellular phones. The display may be a flat panel.

In the description below, "pixel circuit" and "pixel" are used interchangeably. In the description below, "signal" and "line" may be used interchangeably. In the description below, the terms "line" and "node" may be used interchangeably. In the description below, the terms "select line" and "address line" may be used interchangeably. In the description below, "connect (or connected)" and "couple (or coupled)" may be used interchangeably, and may be used to indicate that two or more elements are directly or indirectly in physical or electrical contact with each other.

Figure 1:
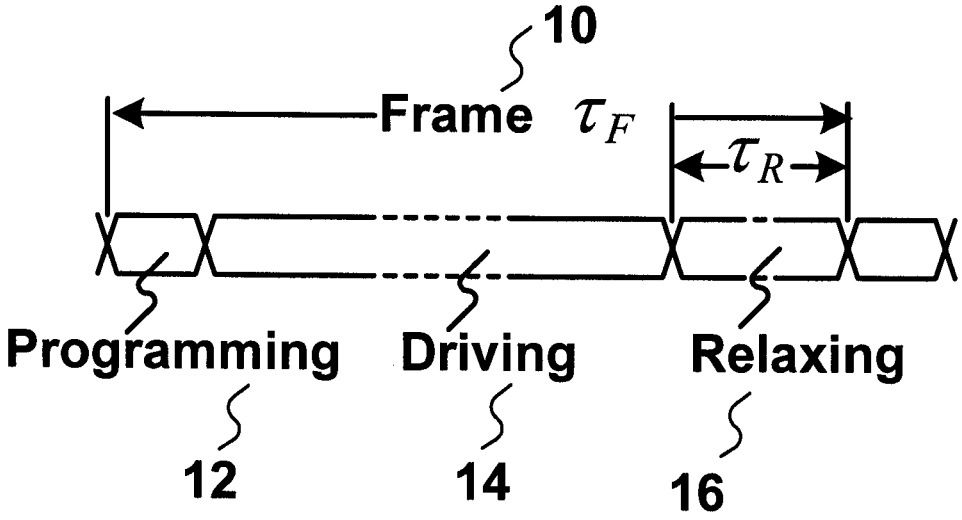
FIG. 1 is a timing chart for suppressing aging of a pixel circuit, in accordance with an embodiment of the present invention

FIG. 1 illustrates a timing schedule for suppressing aging for a pixel circuit, in accordance with an embodiment of the present invention. The pixel circuit, which is operated using the timing schedule of FIG. 1, includes a plurality of transistors and an OLED (e.g., 22, 24, 26 of FIG. 2). In FIG. 1, a frame 10 is divided into three phases: a programming cycle 12, a driving (i.e., emitting) cycle 14, and a relaxing cycle 16. The frame 10 is a time interval or period in which a display shows a frame of a video signal. During the programming cycle 12, a pixel circuit is programmed with required data to provide the wanted brightness. During the driving cycle 14, the OLED of the pixel circuit emits required brightness based on the programming data. Finally, during the relaxing cycle 16, the pixel circuit is OFF or biased with reverse polarity of the driving cycle 14. Consequently, the aging effect causes by the driving cycle 14 is annealed. This prevents aging accumulation effect from one frame to the other frame, and so the pixel life time increases significantly.

To obtain the wanted average brightness, the pixel circuit is programmed for a higher brightness since it is OFF for a fraction of frame time (i.e., relaxing cycle 16). The programming brightness based on wanted one is given by:

$$L_{CP} = \left(\frac{\tau_F}{\tau_F - \tau_R}\right) L_N \tag{1}$$

where "$L_{CP}$" is a compensating luminance, "$L_N$" is a normal luminance, "$\tau_R$" is a relaxation time (16 of FIG. 1), and "$\tau_P$" is a frame time (10 of FIG. 1).

As described below, letting the pixel circuit relax for a fraction of each frame can control the aging of the pixel, which includes the aging of driving devices (i.e., TFTs 24 and 26 of FIG. 2), the OLED (e.g., 22 of FIG. 1), or combinations thereof.

Figure 2:
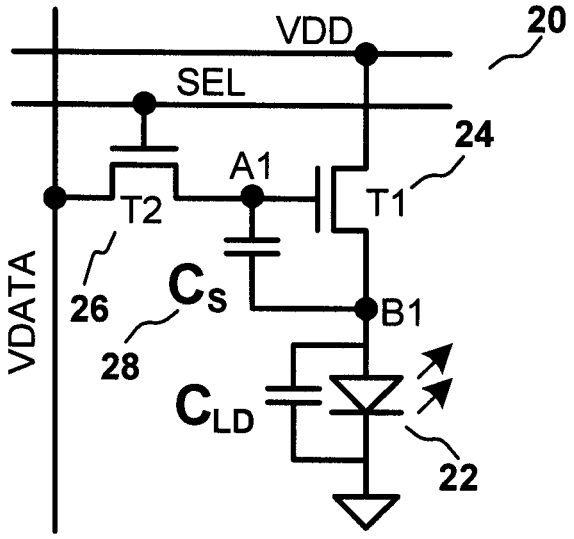
FIG. 2 is a diagram illustrating an example of a pixel circuit to which the timing schedule of FIG. 1 is suitably applied.

FIG. 2 illustrates an example of a pixel circuit to which the timing schedule of FIG. 1 is applicable. The pixel circuit 20 of FIG. 2 is a 2-TFT pixel circuit. The pixel circuit 20 includes an OLED 22, a drive TFT 24, a switch TFT 26, and a storage capacitor 28. Each of the TFTs 24 and 26 have a source terminal, a drain terminal and a gate terminal. In FIG. 2, $C_{LD}$ represents OLED capacitance. The TFTs 24 and 26 are n-type TFTs. However, it would be appreciated by one of ordinary skill in the art that the driving schemed of FIG. 1 is applicable to a complementary pixel circuit having p-type transistors or the combination of n-type and p-type transistors.

One terminal of the drive TFT 24 is connected to a power supply line VDD, and the other terminal of the drive TFT 24 is connected to one terminal of the OLED 22 (node B1). One terminal of the switch TFT 26 is connected to a data line VDATA, and the other terminal of the switch TFT 26 is connected to the gate terminal of the drive TFT 24 (node A1). The gate terminal of the switch TFT 26 is connected to a select line SEL. One terminal of the storage capacitor 28 is connected to node A1, and the other terminal of the storage capacitor 28 is connected to node B1.

Figure 3:
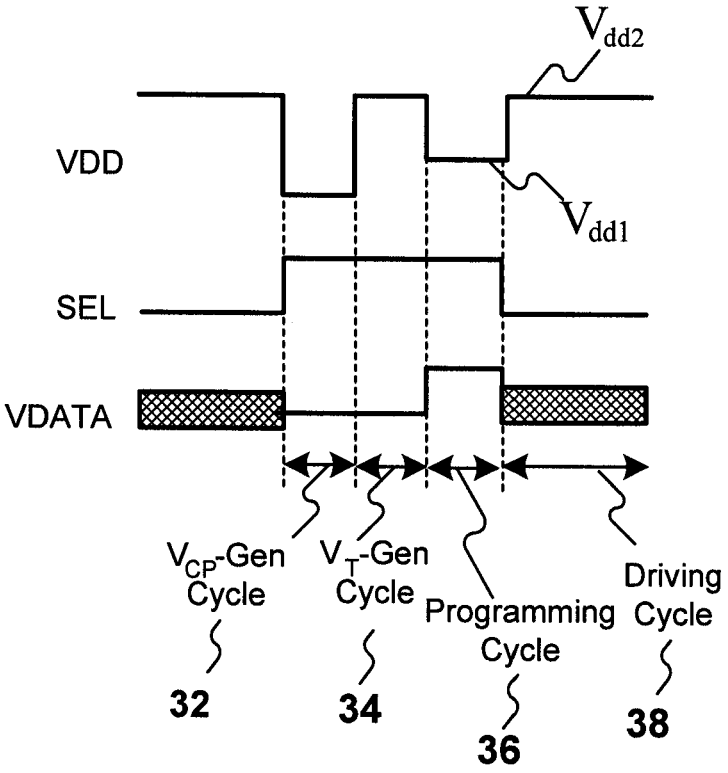
FIG. 3 is an exemplary timing chart for a compensating driving scheme in accordance with an embodiment of the present invention.

FIG. 3 illustrates an exemplary time schedule for a compensating driving scheme in accordance with an embodiment of the present invention, which is applicable to the pixel of FIG. 2. In FIG. 3, "32" represents "$V_{CP}$-Gen cycle", "34" represents "$V_T$-Gen cycle", "36" represents "programming cycle" and associated with the programming cycle 12 of FIG. 1, and "38" represents "driving cycle" and associated with the driving cycle 14 of FIG. 1.

The waveforms of FIG. 3 are used, for example, in the cycles 12 and 14 of FIG. 1. During the $V_{CP}$-Gen cycle 32, a voltage is developed across the gate-source voltage of a drive TFT (e.g., 24 of FIG. 2). During the $V_T$-Gen cycle 34, voltage at node B1 becomes $-V_T$ of the drive TFT (e.g., 24 of FIG. 2) where $V_T$ is the threshold voltage of the drive TFT (e.g., 24 of FIG. 2). During the programming cycle 36, node A1 is charged to $V_P$ which is related to Lcp of (1).

Referring to FIGS. 2 and 3, during the first operating cycle 32 ("$V_{CP}$-Gen"), VDD changes to a negative voltage ($-V_{CPB}$) while VDATA has a positive voltage ($V_{CPA}$). Thus, node A1 is charged to $V_{CPA}$, and node B1 is discharged to $-V_{CPB}$. $V_{CPA}$ is smaller than $V_{TO}+V_{OLEDO}$, where the $V_{TO}$ is the threshold voltage of the unstressed drive TFT 24 and the $V_{OLEDO}$ is the ON voltage of the unstressed OLED 22.

During the second operating cycle 34 ("$V_T$-Gen"), VDD changes to $V_{dd2}$ that is a voltage during the driving cycle 38. As a result, node B1 is charged to the point at which the drive TFT 24 turns off. At this point, the voltage at node B1 is ($V_{CPA}-V_T$) where $V_T$ is the threshold of the drive TFT 24, and the voltage stored in the storage capacitor 28 is the $V_T$ of the drive TFT 24.

During the third operating cycle 36 ("programming cycle"), VDATA changes to a programming voltage, $V_{CPA}+V_P$. VDD goes to Vdd1 which is a positive voltage. Assuming that the OLED capacitance ($C_{LD}$) is large, the voltage at node B1 remains at $V_{CPA}-V_T$. Therefore, the gate-source voltage of the drive TFT 24 ideally becomes $V_P+V_T$. Consequently, the pixel current becomes independent of ($\Delta V_T+\Delta V_{OLED}$) where $\Delta V_T$ is a shift of the threshold voltage of the drive TFT 24 and $\Delta V_{OLED}$ is a shift of the ON voltage of the OLED 22.

Figure 4:
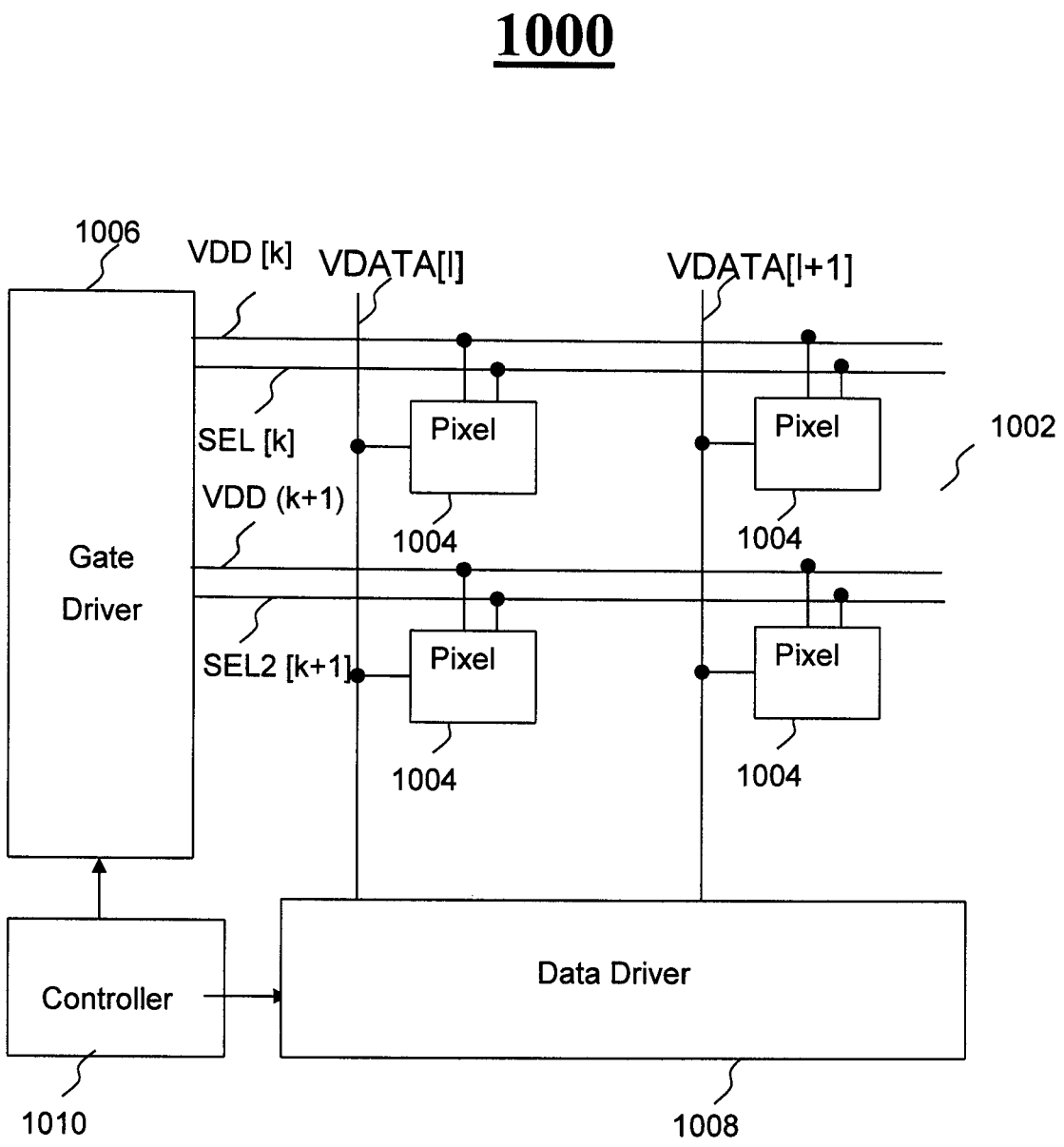
FIG. 4 is a diagram illustrating an example of a display system for implementing the timing schedule of FIG. 1 and the compensating driving scheme of FIG. 3.

FIG. 4 illustrates an example of a display system for implementing the timing schedule of FIG. 1 and the compensating driving scheme of FIG. 3. The display system 1000 includes a pixel array 1002 having a plurality of pixels 1004. The pixel 1004 corresponds to the pixel 20 of FIG. 2. However, the pixel 1004 may have structure different from that of the pixel 20. The pixels 1004 are arranged in row and column. In FIG. 4, the pixels 1004 are arranged in two rows and two columns. The number of the pixels 1004 may vary in dependence upon the system design, and does not limited to four. The pixel array 1002 is an active matrix light emitting display, and may form an AMOLED display.

"SEL[i]" is an address line for the ith row (i= . . . k, k+1 . . . ) and corresponds to SEL of FIG. 2. "VDD[i]" is a power supply line for the ith row (i= . . . k, k+1 . . . ) and corresponds to VDD of FIG. 2. "VDATA[j]" is a data line for the jth row (i= . . . 1, 1+1 . . . ) and corresponds to VDATA of FIG. 2.

A gate driver 1006 drives SEL[i] and VDD[i]. The gate driver 1006 includes an address driver for providing address signals to SEL[i]. A data driver 1008 generates a programming data and drives VDATA[j]. The controller 1010 controls the drivers 1006 and 1008 to drive the pixels 1004 based on the timing schedule of FIG. 1 and the compensating driving scheme of FIG. 3.

Figure 5:
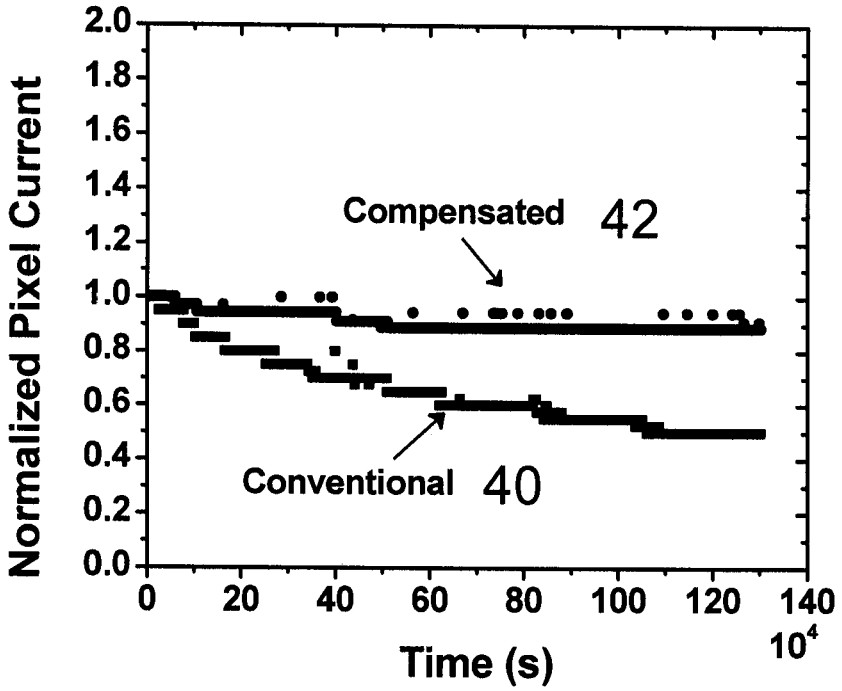
FIG. 5 is a graph illustrating measurement results for a conventional driving scheme and the compensating driving scheme of FIG. 3.

FIG. 5 illustrates lifetime results for a conventional driving scheme and the compensating driving scheme. Pixel circuits of FIG. 2 are programmed for 2 μA at a frame rate of ~60 Hz by using the conventional driving scheme (40) and the compensating driving scheme (42). The compensating driving scheme (42) is highly stable, reducing the total aging error to less than 10%. By contrast, in the conventional driving scheme (40), while the pixel current becomes half of its initial value after 36 hours, the aging effects result in a 50% error in the pixel current over the measurement period. The total shift in the OLED voltage and threshold voltage of the drive TFT (i.e., 24 of FIG. 2), $\Delta(V_{OLED}+V_T)$, is ~4 V.

Figure 6:
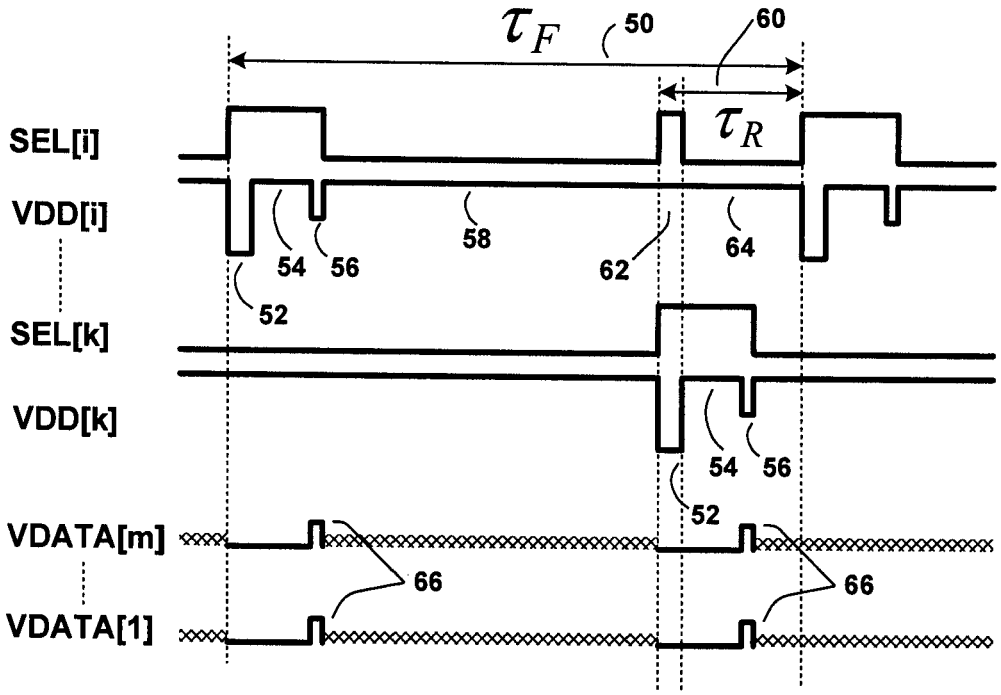
FIG. 6 is a timing chart illustrating an example of frames based on the timing schedule of FIG. 1 and the compensating driving scheme of FIG. 3.

FIG. 6 illustrates an example of frames using the timing schedule of FIG. 1 and the compensating driving scheme of FIG. 3.

In FIG. 6, "i" represents the ith row in a pixel array, "k" represents the kth row in the pixel array, "m" represents the mth column in the pixel array, and "l" represents the lth column in the pixel array. The waveforms of FIG. 6 are applicable to the display system 1000 of FIG. 4 to operate the pixel array 1002 of FIG. 4. It is assumed that the pixel array includes more than one pixel circuit 20 of FIG. 2.

In FIG. 6, "50" represents a frame for the ith row and corresponds to "10" of FIG. 1, "52" represents "$V_{CP}$-Gen cycle" and corresponds to "32" of FIG. 3, "54" represents "$V_T$-Gen cycle" and corresponds to "34" of FIG. 3, and "56" represents "programming cycle" and corresponds to "36" of FIG. 3. In FIG. 6, "58" represents "driving cycle" and corresponds to "38" of FIG. 3. In FIG. 6, "66" represents the values of the corresponding VDATA lines during the operating cycle 56.

In FIG. 6, "60" represents a relaxing cycle for the ith row and corresponds to "16" of FIG. 1. The relaxing cycle 60 includes a first operating cycle "62" and a second operating cycle "64". During the relaxing cycle 60 for the ith row, SEL[i] is high at the first operating cycle 62 and then is low at the second operating cycle 64. During the frame cycle 62, node A1 of each pixel at the ith row is charged to a certain voltage, such as, zero. Thus, the pixels are OFF during the frame cycle 64. "$V_{CP}$-Gen cycle" 52 for the kth row occurs at the same timing of the first operating cycle 62 for the ith row.

During the first operating cycle 52 for the kth row, which is the same as the first operating cycle 62 for the ith row, SEL[i] is high, and so the storage capacitors of the pixel circuits at the ith row are charged to $V_{CP4}$. VDATA lines have $V_{CP4}$. Considering that $V_{CP4}$ is smaller than $V_{OLED0}+V_{T0}$, the pixel circuits at the ith row are OFF at the second operating cycle 64 and also the corresponding drive TFTs (24 of FIG. 2) are negatively biased resulting in partial annealing of the $V_T$-shift at the cycle 64.

Figure 7:
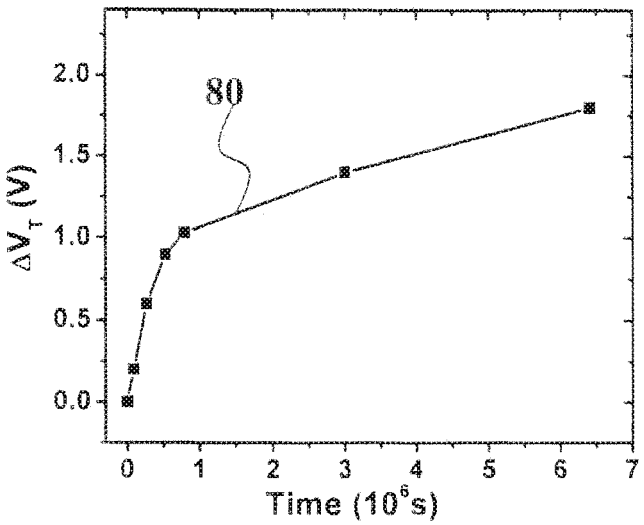
FIG. 7 is a graph illustrating the measurement result of threshold voltage shift based on the compensating driving scheme of FIG. 6.
Figure 8:
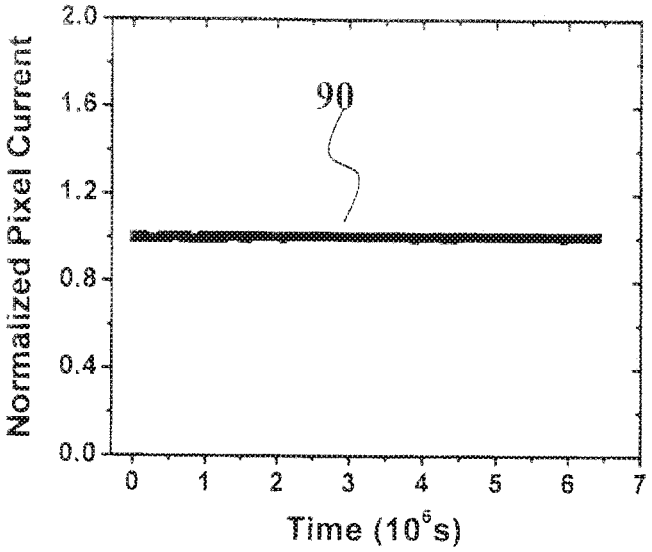
FIG. 8 is a graph illustrating the measurement result of OLED current based on the compensating driving scheme of FIG. 6.

FIGS. 7 and 8 illustrate results of a longer lifetime test for a pixel circuit employing the timing cycles of FIG. 6. To obtain data of FIGS. 7 and 8, a pixel array having more than one pixel 20 of FIG. 2 was used.

In FIG. 7, "80" represents the measurement result of the shift in the threshold voltage of the drive transistor (i.e., 24 of FIG. 2). The result signifies that the above method and results in a highly stable pixel current even after 90 days of operation. Here, the pixel of FIG. 2 is programmed for 2.5 μA to compensate for the luminance lost during the relaxing cycle. The $\Delta(V_{OLED}+V_T)$ is extracted once after a long timing interval (few days) to not disturb pixel operation. It is clear that the OLED current is significantly stable after 1500 hours of operation which is the results of suppression in the aging of the drive TFT (i.e., 24 of FIG. 2) as shown in FIG. 7.

In FIG. 8, "90" represents the measurement result of OLED current of the pixel (i.e., 20 of FIG. 2) over time. The result depicted in FIG. 8 confirms that the enhanced timing diagram suppresses aging significantly, resulting in longer lifetime. Here, $\Delta(V_{OLED}+V_T)$ is 1.8 V after a 90 days of operation, whereas it is 3.6 V for the compensating driving scheme without the relaxing cycle after a shorter time.

Figure 9:
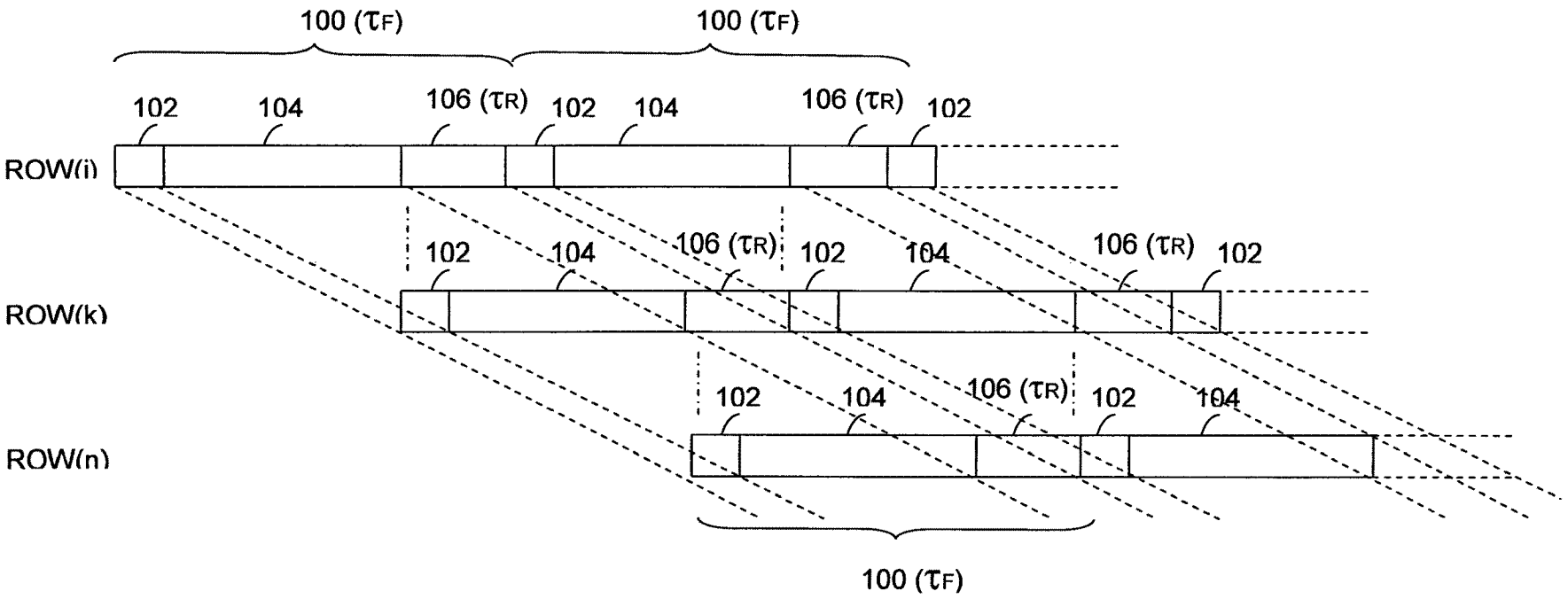
FIG. 9 is a diagram illustrating an example of a driving scheme applied to a pixel array, in accordance with an embodiment of the present invention.

FIG. 9 is a diagram illustrating an example of the driving scheme applied to a pixel array, in accordance with an embodiment of the present invention. In FIG. 9, each of ROW (i), ROW(k) and ROW (n) represents a row of the pixel array. The pixel array may be the pixel array 1002 of FIG. 4. The frame 100 of FIG. 9 includes a programming cycle 102, a driving cycle 104, and a relaxing cycle 106, and has a frame time "$\tau_F$". The programming cycle 102, the driving cycle 104, and the relaxing cycle 106 may correspond to the operation cycles 12, 14, and 16 of FIG. 1, respectively. The programming cycle 102 may include the operating cycles 32, 34 and 36 of FIG. 3. The relaxing cycle 106 may be similar to the relaxing cycle 60 of FIG. 6.

The programming cycle 102 for the kth row occurs at the same timing of the relaxing cycle 106 for the ith row. The programming cycle 102 for the nth row occurs at the same timing of the relaxing cycle 106 for the kth row.

Figure 10A:
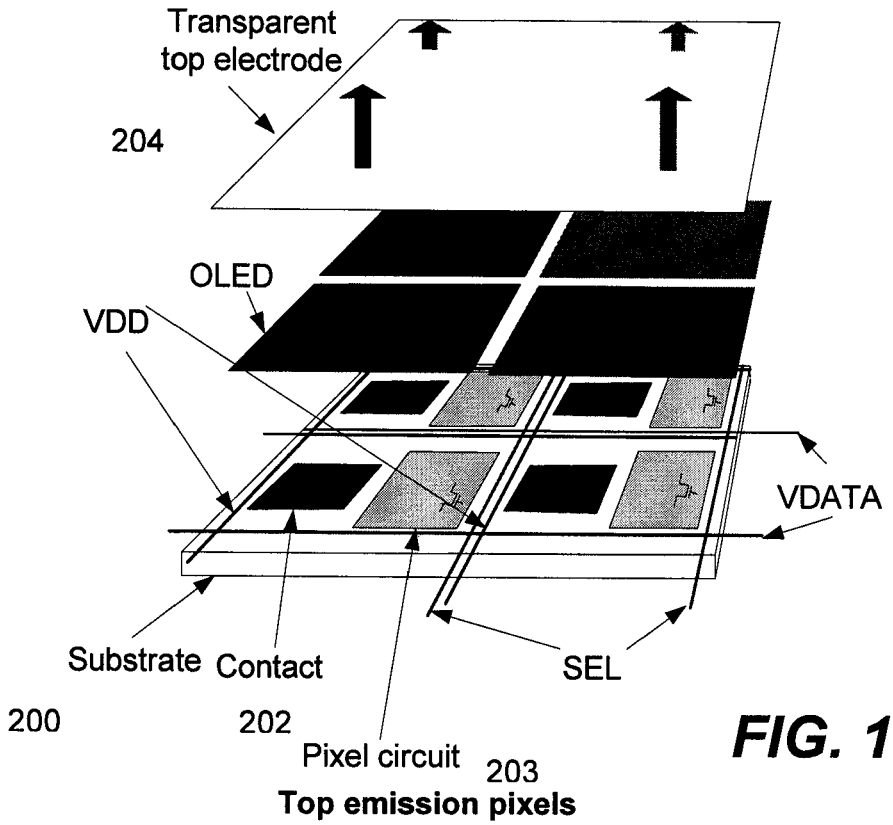
FIG. 10(*a*) is a diagram illustrating an example of array structure having top emission pixels applicable to the display system of FIG. 4.
Figure 10B:
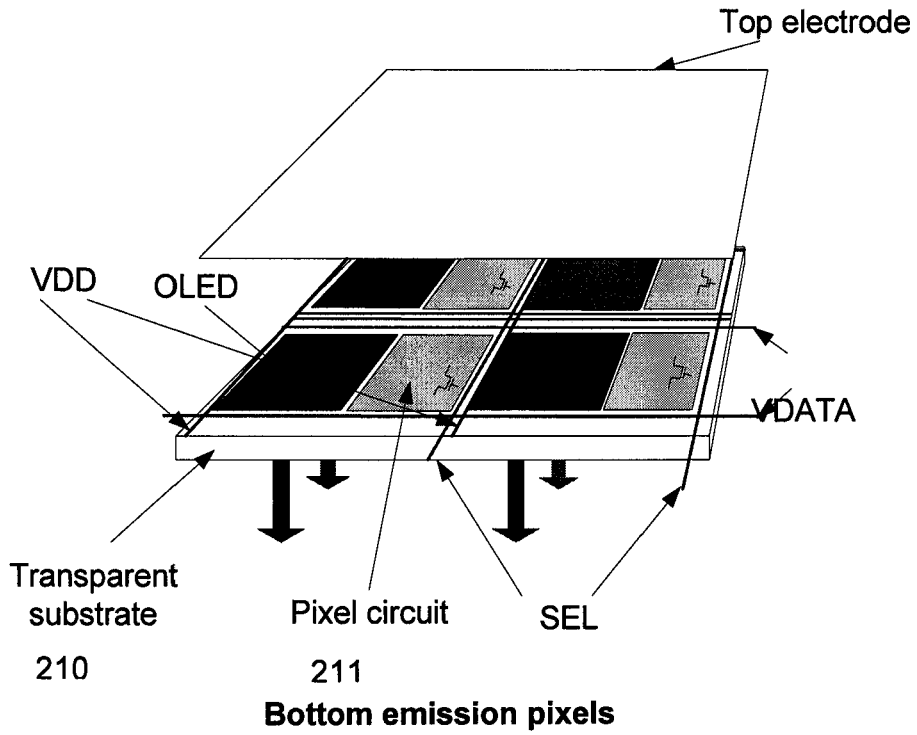

FIG. 10(*a*) illustrates an example of array structure having top emission pixels. FIG. 10(*b*) illustrates an example of array structure having bottom emission pixels. The pixel array of FIG. 4 may have the array structure of FIG. 10(*a*) or 10(*b*). In FIG. 10(*a*), 200 represents a substrate, 202 represents a pixel contact, 203 represents a (top emission) pixel circuit, and 204 represents a transparent top electrode on the OLEDs. In FIG. 10(*b*), 210 represents a transparent substrate, 211 represents a (bottom emission) pixel circuit, and 212 represents a top electrode. All of the pixel circuits including the TFTs, the storage capacitor, the SEL, VDATA, and VDD lines are fabricated together. After that, the OLEDs are fabricated for all pixel circuits. The OLED is connected to the corresponding driving transistor using a via (e.g., B1 of FIG. 2) as shown in FIGS. 10(*a*) and 10(*b*). The panel is finished by deposition of the top electrode on the OLEDs which can be a continuous layer, reducing the complexity of the design and can be used to turn the entire display ON/OFF or control the brightness.

In the above description, the pixel circuit 20 of FIG. 2 is used as an example of a pixel circuit for implementing the timing schedule of FIG. 1, the compensating driving schedule of FIG. 3, and the timing schedule of FIG. 6. However, it is appreciated that the above timing schedules of FIGS. 1, 3 and 6 are applicable to pixel circuits other than that of FIG. 2, despite its configuration and type.

Examples of the driving scheme, compensating and driving scheme, and pixel/pixel arrays are described in G. R. Chaji and A. Nathan, "Stable voltage-programmed pixel circuit for AMOLED displays," IEEE J. of Display Technology, vol. 2, no. 4, pp. 347-358, December 2006, which is hereby incorporated by reference.

One or more currently preferred embodiments have been described by way of example. It will be apparent to persons skilled in the art that a number of variations and modifications can be made without departing from the scope of the invention as defined in the claims.

What is claimed is:

1. A method of operating a pixel array having pixel circuits, each pixel circuit including a drive transistor and a light emitting device, and driven by repeating an operation cycle defining a frame period for each pixel circuit, the method comprising:

providing first voltages to a first pixel circuit during a programming operation cycle of a frame period of the first pixel circuit; and providing second voltages to a second pixel circuit while said providing said first voltages to said first pixel circuit during a relaxing operation cycle of a frame period of the second pixel circuit, said second voltages relaxing said second pixel without resetting said second pixel.

2. The method of claim 1, wherein the first voltages and the second voltages each comprise a first voltage provided via a signal line coupled to the first pixel circuit and the second pixel circuit.

3. The method of claim 2, wherein the first voltages comprise a first supply voltage used to drive the light emitting device of the first pixel circuit, wherein the second voltages comprise a second supply voltage used to drive the light emitting device of the second pixel circuit, the first supply voltage different from the second supply voltage, and wherein a polarity of the first supply voltage is opposite in polarity to that of the first voltage.

4. The method of claim 2, further comprising:

providing a second voltage to the first pixel circuit over the signal line during a relaxing operation cycle of the frame period of the first pixel circuit; and deselecting the second pixel circuit during the relaxing operation cycle of the frame period of the first pixel circuit isolating the second pixel circuit from the second voltage on the signal line.

5. The method of claim 1, further comprising:

during said providing said first voltages to the first pixel circuit and said providing said second voltages to the second pixel circuit, selecting the first pixel circuit and selecting the second pixel circuit.

6. The method of claim 5, wherein the first voltages comprise a first voltage provided over a signal line coupled to the first pixel circuit and the second pixel circuit, the first voltage smaller than $V_{T0}+V_{OLED0}$ where $V_{T0}$ is a threshold voltage of the drive transistor of the first pixel circuit in an unstressed state and $V_{OLED0}$ is an on voltage of the light-emitting device of the first pixel circuit in an unstressed state.

7. The method of claim 1, wherein the first voltages are sufficient to cause, during the programming operation cycle of the frame period of the first pixel circuit, the drive transistor of the first pixel circuit to turn on and the light emitting device of the first pixel circuit to remain off.

8. The method of claim 1, wherein the second voltages are sufficient to cause, during the relaxing operation cycle of the frame period of the second pixel circuit, the drive transistor of the second pixel circuit to turn off and the light emitting device of the second pixel circuit to turn off.

9. The method of claim 1, wherein the second voltages are sufficient to cause, during the relaxing operation cycle of the frame period of the second pixel circuit, biasing of the transistor of the second pixel circuit with reversed polarity.

10. The method of claim 1, further comprising:

deselecting the second pixel circuit at the end of the relaxing operation cycle of the frame period of the second pixel circuit.

11. A display system comprising:

a pixel array having pixel circuits, each pixel circuit including a drive transistor and a light emitting device;

a driver coupled to the pixel circuits and for driving the pixel circuits by repeating an operation cycle defining a frame period for each pixel circuit;

and a controller coupled to the driver, the controller operable to:

provide first voltages to a first pixel circuit during a programming operation cycle of a frame period of the first pixel circuit; and provide second voltages to a second pixel circuit while said providing said first voltages to said first pixel circuit and during a relaxing operation cycle of a frame period of the second pixel circuit, said second voltages relaxing said second pixel without resetting said second pixel.

12. The display system of claim 11, further comprising:

a signal line coupled to the first pixel circuit and the second pixel circuit, the first voltages and the second voltages each comprise a first voltage provided via the signal line to the first pixel circuit and the second pixel circuit.

13. The display system of claim 12, wherein the first voltages comprise a first supply voltage used to drive the light emitting device of the first pixel circuit, wherein the second voltages comprise a second supply voltage used to drive the light emitting device of the second pixel circuit, the first supply voltage different from the second supply voltage, and wherein a polarity of the first supply voltage is opposite in polarity to that of the first voltage.

14. The display system of claim 12, wherein the controller is further operable to:

provide a second voltage to the first pixel circuit over the signal line during a relaxing operation cycle of the frame period of the first pixel circuit; and deselect the second pixel circuit during the relaxing operation cycle of the frame period of the first pixel circuit isolating the second pixel circuit from the second voltage on the signal line.

15. The display system of claim 11, wherein the controller is further operable to:

during providing said first voltages to the first pixel circuit and providing said second voltages to the second pixel circuit, select the first pixel circuit and select the second pixel circuit.

16. The display system of claim 15, wherein the first voltages comprise a first voltage provided over a signal line coupled to the first pixel circuit and the second pixel circuit, the first voltage smaller than $V_{T0}+V_{OLEP0}$ where $V_{T0}$ is a threshold voltage of the drive transistor of the first pixel circuit in an unstressed state and $V_{OLED0}$ is an on voltage of the light-emitting device of the first pixel circuit in an unstressed state.

17. The display system of claim 11, wherein the first voltages are sufficient to cause, during the programming operation cycle of the frame period of the first pixel circuit, the drive transistor of the first pixel circuit to turn on and the light emitting device of the first pixel circuit to remain off.

18. The display system of claim 11, wherein the second voltages are sufficient to cause, during the relaxing operation cycle of the frame period of the second pixel circuit, the drive transistor of the second pixel circuit to turn off and the light emitting device of the second pixel circuit to turn off.

19. The display system of claim 11, wherein the second voltages are sufficient to cause, during the relaxing operation cycle of the frame period of the second pixel circuit, biasing of the transistor of the second pixel circuit with reversed polarity.

20. The display system of claim 11, wherein the controller is further operable to:

deselect the second pixel circuit at the end of the relaxing operation cycle of the frame period of the second pixel circuit.

* * * * *